United States Patent [19]

Rodriguez

[11] Patent Number: 4,677,779

[45] Date of Patent: Jul. 7, 1987

[54] ELEVATOR DISPLAY SYSTEM

[76] Inventor: Anthony R. Rodriguez, 3847 Timberglen, Apt. 4212, Dallas, Tex. 75252

[21] Appl. No.: 831,003

[22] Filed: Feb. 10, 1986

[51] Int. Cl.[4] ..... G09F 11/18

[52] U.S. Cl. ..... 40/514; 40/517; 40/582; 40/442; 187/1 R

[58] Field of Search ..... 40/514, 517, 529, 487, 40/442, 582; 340/19 R; 187/1 R

[56] References Cited

U.S. PATENT DOCUMENTS

| | | | |
|---|---|---|---|
| 446,907 | 2/1891 | Whitlock | 340/19 R |
| 459,083 | 9/1891 | Thompson | 116/64 |
| 2,012,257 | 8/1935 | Burch | 40/82 |
| 2,319,287 | 5/1943 | Arendt | 187/1 R |
| 3,517,774 | 6/1970 | Meyer | 187/6 |
| 3,983,652 | 10/1976 | Beaty et al. | 40/582 |

*Primary Examiner*—Gene Mancene
*Assistant Examiner*—Cary E. Stone
*Attorney, Agent, or Firm*—Glaser, Griggs & Schwartz

[57] ABSTRACT

A dynamic display system in which a visual display is changeable in accordance with the vertical movement of an elevator. The display system is adapted for use in combination with a conventional elevator assembly having an elevator shaft, an elevator cab which is moveable within the shaft, and an elevator well at the bottom of the shaft. A display banner or the like is coupled at one end thereof to the underside of the elevator cab and at the other end thereof to a drum within the elevator well. As the elevator cab rises within the shaft, the display banner is pulled out from the elevator well so that the information printed on the display banner is gradually exposed as the banner ascends from the well. As the elevator cab descends, the banner retracts into the elevator well. In another embodiment, a bank of light generating devices, such as lasers or the like, housed within the elevator well, emits light beams into the elevator shaft. The underside of the elevator cab is fitted with a light reflective surface for reflecting the light beams so that a visual display is created in the elevator shaft, which varies with movement of the elevator cab.

14 Claims, 8 Drawing Figures

ELEVATOR DISPLAY SYSTEM

FIELD OF THE INVENTION

The present invention relates generally to display systems and in particular to a display system which is operated by the movement of an elevator to provide a dynamic display.

BACKGROUND OF THE INVENTION

Dynamic display systems have many applications, including, but not limited to, the communication of real-time information, such as time and weather information, and advertising and promotion. Dynamic display systems have the advantage, as compared to static displays, of being able to provide more information in a given display area to attract greater attention because of the changeable nature of the display.

DESCRIPTION OF THE PRIOR ART

Conventional dynamic display systems typically use electronic or mechanical devices which permit display information to be changed as desired. Electronic display systems typically include a display device, such as a cathode ray tube, diode display or a character generator for translating electronic signals into an alphanumeric display and a control system for inputting information and controlling the information being displayed. Mechanical display systems typically include an actuator and a dedicated drive mechanism for selectively changing a visual display.

OBJECTS OF THE INVENTION

The principal object of the present invention to provide an improved dynamic display system.

Another object of the invention is to provide a display system in which the display information is changed by the movement of an elevator to which the display is attached.

Still another object of the invention is to provide a changeable display system which is operable without the need for a dedicated drive system for the display.

Yet another object of the invention is to provide an optical display which is changeable in accordance with the vertical movement of an elevator.

SUMMARY OF THE INVENTION

These and other objects are accomplished in accordance with the present invention wherein a display system comprises an elevator car moveable between vertically spaced first and second positions and means cooperating with the elevator car for providing a visual display between the elevator car and at least one of the first and second positions. The display is changeable in accordance with the movement of the elevator car between the first and second positions. The elevator includes an elevator shaft extending between the first and second positions, an enclosed elevator cab moveable through the shaft between the first and second positions and a drive cable for selectively raising and lowering the elevator cab. The first position represents the lower limit of travel of the elevator cab and the second position represents the upper limit of travel of the cab.

In one embodiment the display means includes a spring-loaded drum mounted below the first position and a banner, at least a portion of which is wound around the drum. One end of the banner is attached to the elevator cab so that the banner is pulled off of the drum against the spring bias of the drum as the elevator cab moves upwardly away from the first position and towards the second position. As the elevator cab moves downwardly towards the first position, the banner is taken up by rotation of the drum and wound onto the drum as the drum turns.

In another embodiment, the display means comprises a pleated banner which is attached at one end thereof to the elevator cab. The banner rises from a pleatsed stack located in the elevator well beneath the first position as the elevator cab rises from the first position upwardly toward the second position. Similarly, as the elevator cab moves downwardly to the first position, the banner folds upon itself to form a pleated stack within the elevator well.

In the preferred embodiment, the display banner is comprised of a cloth or tapestry having a message imprinted thereon. As the elevator moves upwardly in the shaft, the tapestry is advanced upwardly from the well so that the display gradually changes in accordance with the movement of the elevator. As the elevator cab is lowered, the tapestry retracts into the well. The elevator shaft is preferably open on one side along the entire length thereof so that the display is visible externally to the shaft.

In another aspect of the invention the display means is comprised of a light beam generator disposed adjacent to at least one of the first and second positions and a light reflective surface mounted on the elevator cab in facing relationship with the light beam generator. Multiple light beams are directed toward the reflective surface and reflect off the surface to provide a visual display in the elevator shaft between the light beam generator and the elevator cab.

In the preferred embodiment the light beam generator is located in the elevator well beneath the lowermost position of the elevator and is preferably comprised of a bank of laser emitters, which emit light of different colors. The reflective surface is preferably mounted onto the underside of the elevator cab so that the display is visible in the elevator shaft between the lower portion of the cab and the elevator well. As the elevator cab moves up and down in the shaft, the visual light beam display changes accordingly.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances, proportions have been exaggerated in order to more clearly depict certain features of the invention.

Figure 1:
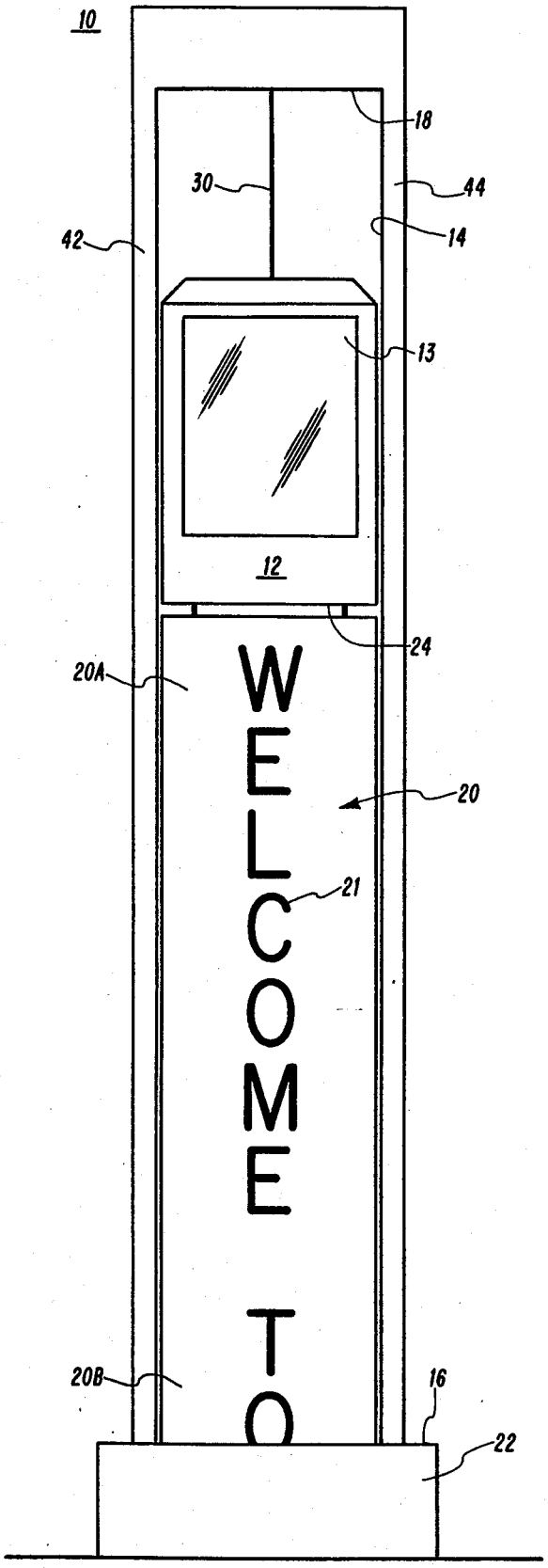
FIG. 1 is a front elevational view of an elevator display system according to the present invention.

Referring to FIG. 1, an elevator display system 10 according to the pressent invention includes a conventinal elevator assembly having an elevator cab 12 with an observation window 13. The cab 12 is moveable within an elevator shaft 14 between vertically spaced first and second stations 16 and 18. A display banner 20 is attached to the underside of elevator cab 12. Display banner 20 is retracted within elevator well 22 when cab 12 moves to the first position 16 at the bottom of shaft 14. As elevator cab 12 moves upwardly in shaft 14, display banner 20 is extended out from well 22 to gradually reveal the full display surface of banner 20. Display banner 20 is preferably made of cloth or tapestry with a message 21 or ornamental display imprinted thereon.

Figure 2:
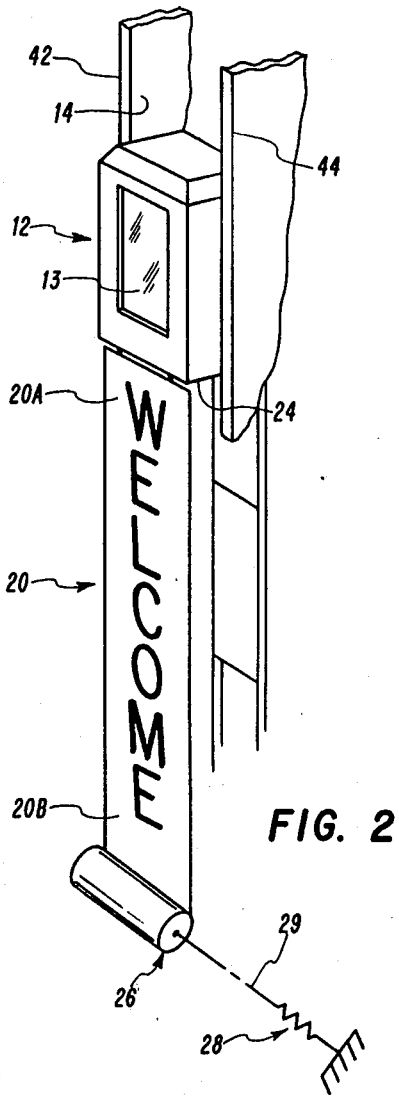
FIG. 2 is a fragmentary perspective view of a first preferred embodiment of the elevator display system shown in FIG. 1.
Figure 4:
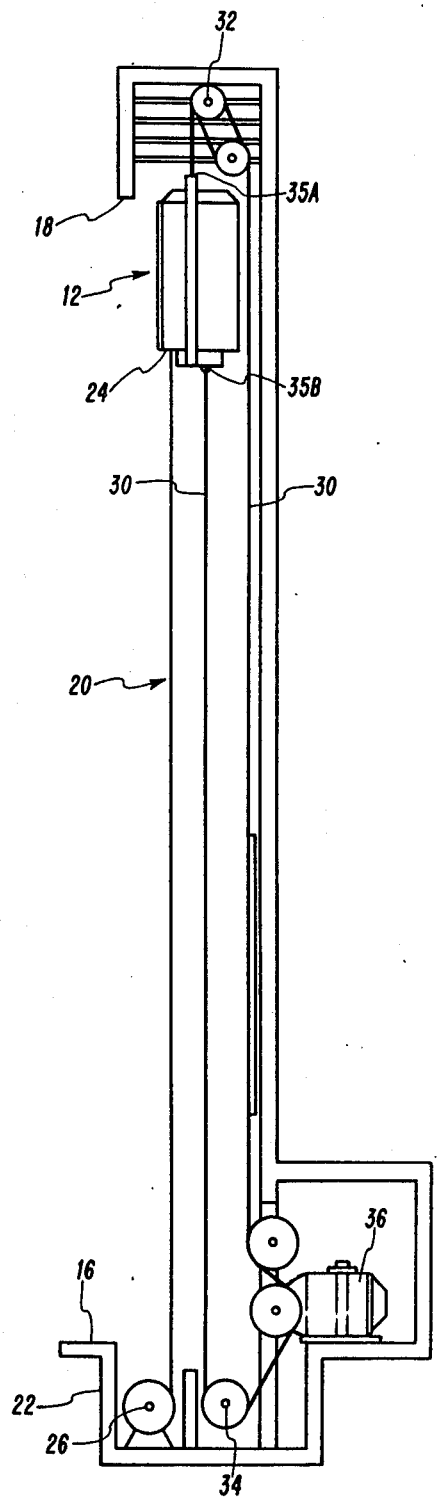
FIG. 4 is a side elevational view of the first preferred embodiment of the present invention.

Referring to FIGS. 2 and 4, a first end portion 20A of banner 20 is attached to elevator cab 12 along bottom panel 24. An opposite end portion 20B is wound about a spring-loaded cylindrical drum 26. Drum 26 includes a torsion spring 28 disposed in the central portion of drum 26 and extending along the central axis 29 thereof.

The spring bias of spring member 28 causes drum 26 to rotate in a clockwise direction as viewed in FIGS. 2 and 4 so that display banner 20 is wound around drum 26 and retracted back into elevator well 22 as cab 12 descends within shaft 14. When elevator cab 12 rises within shaft 14, the spring bias of spring member 28 is overcome and display banner 20 is pulled off of drum 26 and rises upwardly in shaft 14 along with elevator cab 12, thereby gradually exposing the message 21 imprinted on banner 20 as cab 12 ascends.

Figure 3:
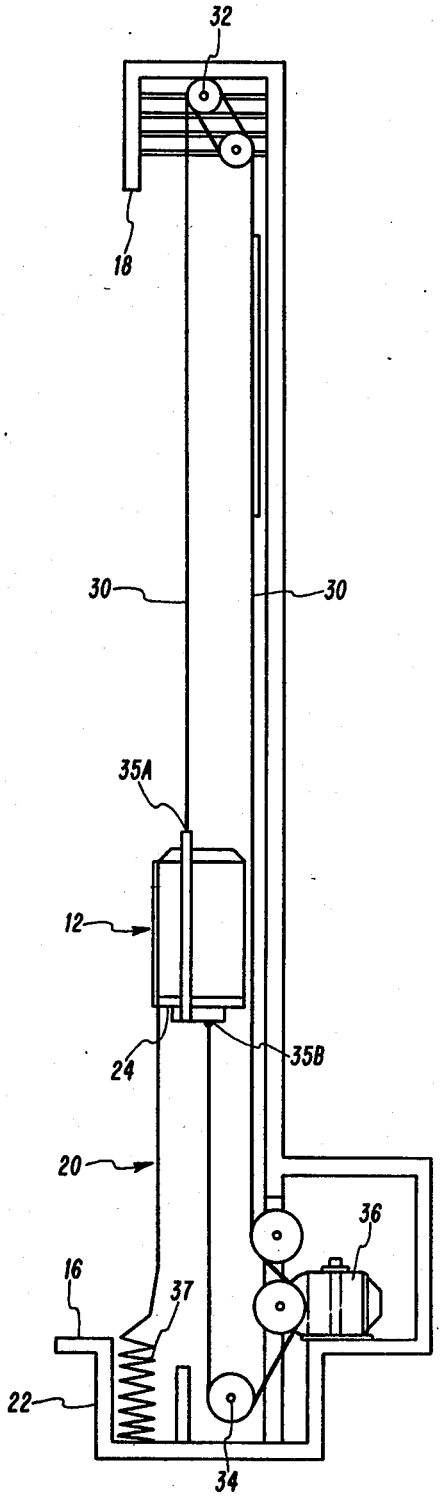
FIG. 3 is a side elevational view of a second embodiment of an elevator display system according to the present invention.

The drive system for the elevator assembly is of conventional design and construction with FIGS. 3 and 4 being simplified illustrations thereof. The drive system includes a cable assembly, indicated generally at 30, which forms a continuous loop around upper and lower pulleys 32 and 34. Cables 30 are attached at opposite ends thereof, as indicated at 35A and 35B, to elevator cab 12 so that cab 12 forms part of the "loop". Cables 30 are driven by a reversible electric motor 36 for moving cables 30 in the desired direction of movement of elevator cab 12. Whe elevator cab 12 is substantially contained within shaft 14, as in FIG. 1, shaft 14 is open on one side along the entire length thereof so that display banner 20 is visible externally to shaft 14. Alternatively, cab 12 may be mounted so that a portion thereof extends outwardly from shaft 14, as in FIG. 2. This arrangement allows shaft 14 to be completely closed off while allowing display banner 20 to be clearly visible because banner 20 is attached to the outwardly extnding portion of elevator cab 12.

The display system may also be used with hydraulic lift elevator arrangements.

Referring to FIG. 3, a second embodiment of the elevator display system is depicted. The display system shown in FIG. 3 is substantially the same as that previously described, except that display banner 20 is pleated so that banner 20 folds upon itself in a stack 37 as it is retracted into elevator well 22 by the downward movement of cab 12. As cab 12 rises, banner 20 is drawn from the folded stack 37 in elevator well 22.

Figure 5:
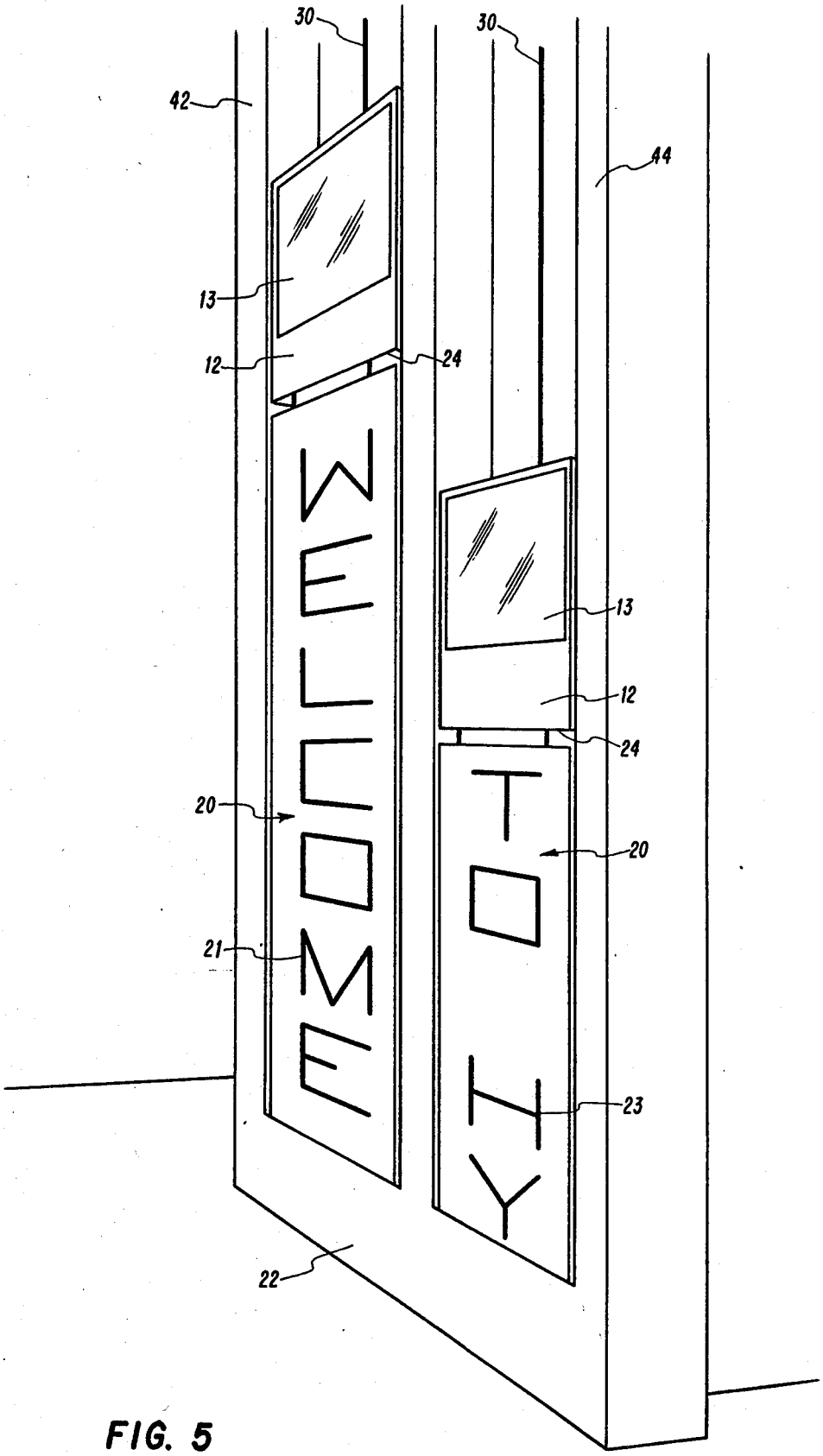
FIG. 5 is a perspective view of a dual bank elevator display system according to the present invention.

Referring to FIG. 5, a plurality of display banners 20 may be disposed side-by-side to convey a composite message 21, 23 as one reads individual banners 20 from left to right. This arrangement may be effected when dual elevators are disposed in side-by-side relationship.

Figure 6:
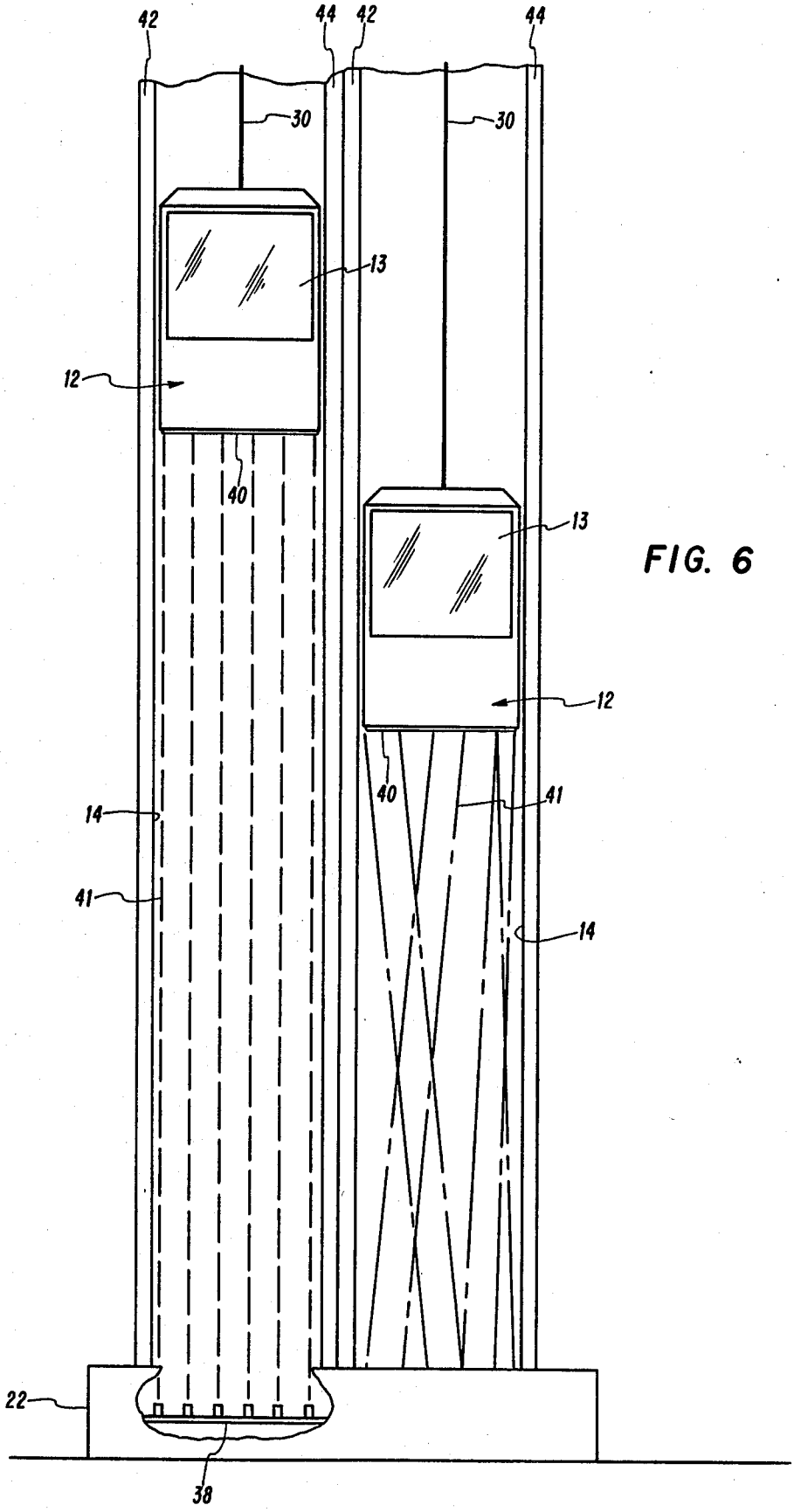
FIG. 6 is a front elevational view of a third embodiment of the present invention.

Referring to FIG. 6, a third embodiment of an elevator display system according to the present invention is shown. A light display is created within elevator shaft 14 between elevator cab 12 and elevator well 22 by a bank of light emitting devices 38, such as lasers and the like, disposed within elevator well 22. The underside of elevator cab 12 is fitted with a light reflective surface 40, such as a glass mirror or sheet of polished metal, for reflecting light beams 41 generated by devices 38 and creating a return path for the light beams as reflected by surface 40. As elevator cab 12 rises and falls within shaft 14, the visual display will be altered to provide an interesting visual effect. Light generating devices 38 may be of various colors and may be programmed to transmit light beam patterns in various sequences as desired.

Figure 7:
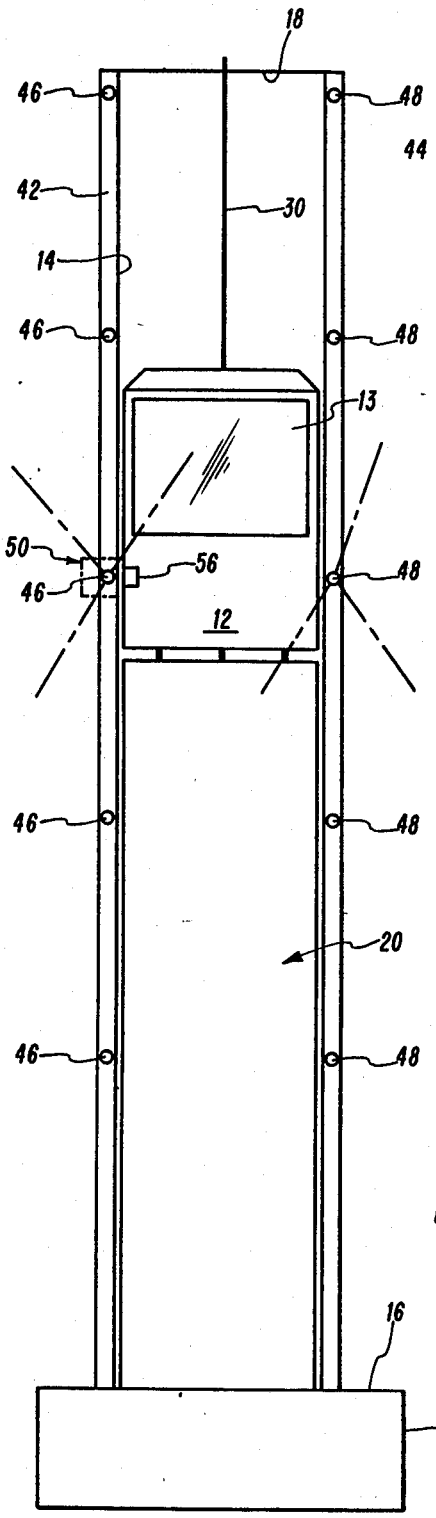
FIG. 7 is a front elevational view of a fourth embodiment of the present invention; and, FIG. 8 is a simplified schematic circuit diagram which forms a part of the elevator display system of FIG. 7.
Figure 8:
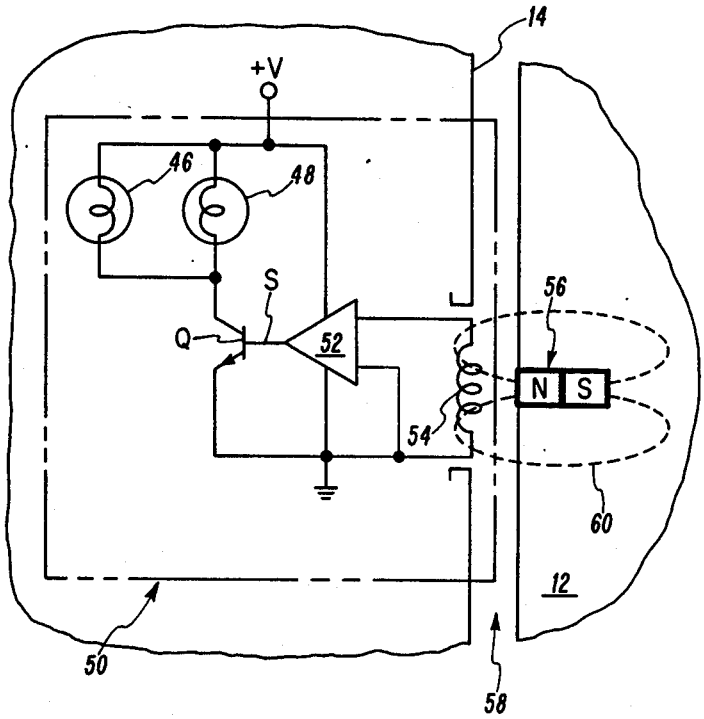

A fourth embodiment of an elevator display system according to the present invention is illustrated in FIGS. 7 and 8. The elevator shaft 14 is enclosed on either side by shaft frames 42, 44. Mounted onto the shaft frames are electrical display lamps 46, 48 respectively. According to this embodiment, the display lamps 46, 48 emit a flash of light as the elevator cab 12 moves upwardly and downwardly within the shaft 14. Each pair of lamps is triggered on for a brief period in response to the operation of a detector circuit 50. A signal S is produced by a comparator 52 in response to the induction of current through a sensor coil 54 lodged within the frame 42. As can best be seen in FIG. 8, the sensor coil 54 is magnetically coupled to a permanent magnet 56 which is carried by the cab 12 and which is separated from the coil 54 by a small air gap 58. The permanent magnet 56 produces lines of magnetic flux 60 which are cut by the sensor coil 54 as the elevator cab 12 moves vertically through the elevation of the permanent magnet 56. The current induced within the sensor coil 54 is detected by the comparator 52 which produces a pulse signal S having a duration substantially the same as the transit time through the permanent magnetic field 60. The output signal S is applied to the gate electrode of transistor switch Q which causes its base to emitter junction to be forwrd biased so that transistor switch Q conducts heavily in the "ON" state, thereby providing a ground path for the electrical display lamps 46, 48. The result is that the parallel connected lamps 46, 48 flash on and off as the elevator moves upwardly and downwardly past each lamp station.

The elevator display system of the present invention may be implemented in connection with the original installation of an elevator assembly or may be retrofitted in connection with existing elevator systems. The display system utilizes available display area and elevator equipment and provides an effective as well as aesthetically pleasing medium for communicating information and the like. Furthermore, the display system of the present invention enhances the overall apperance of an elevator shaft by providing an attractive visual display within the shaft between the elevator cab and the elevator well.

Various embodiments of the invention have been described in detail. Since changes in and modifications to the above-described preferred embodiment may be made without departing from the nature, spirit and scope of the invention, the invention is not to be limited to said details, except as set forth in the appended claims.

What is claimed is:

1. A display system comprising, in combination:

an elevator cab moveable between vertically spaced apart first and second positions; and means cooperating with said elevator cab for providing a visual display between said elevator cab and at least one of said first and second positions, said display being changeable in accordance with the movement of the elevator cab between said first and second positions.

2. The display system according to claim 1 wherein said elevator cab is supported for travel along an elevator shaft extending vertically substantially between said first and second positions, said combination including drive means for selectively raising and lowering the cab.

3. The display system according to claim 2 wherein said drive means comprises a continuous loop cable assembly attached at opposite ends thereof to the elevator cab and reversible motor means for driving the cable assembly in the desired direction of movement of the elevator cab.

4. The display systems according to claim 1 wherein said display means comprises a spring-loaded drum positioned adjacent to at least one of said first and second positions and a flexible banner, at least a portion of which is wound around said drum, one end of said banner being attached to said elevator cab so that said banner is pulled from said drum against the spring bias thereof as the elevator cab moves away from said drum, with the spring bias of said drum retracting said banner onto the drum as the elevator cab moves toward said drum.

5. The display system according to claim 4 wherein said first position corresponds to the lower limit travel of said elevator cab and said second position corresponds to the upper limit of travel of said cab, the combination further including an elevator well located beneath said first position, said spring-loaded drum being located within said elevator well.

6. The display system according to claim 1 wherein said display means comprises a pleated banner which is attached at one end thereof to the elevator cab so that said banner rises from a pleated stack as the elevator cab ascends and the pleated banner folds upon itself to form a pleated stack as the elevator cab descends.

7. The display system according to claim 6, the combination further including an elevator well located beneath the lower limit of travel of the elevator cab, said pleated stack being located within said elevator well.

8. The display system according to claim 1 wherein said display means comprises light generating means positioned adjacent to at least one of said first and second positions for emitting a light beam and a reflective member mounted on a surface of the elevator cab which is in facing relationship with the light generating means for reflecting light emitted thereby, the transmission and reflection of light beams between the light generating means and reflective member providing a visual display between the elevator cab and the light generating means which is changeable in accordance with the movement of the cab.

9. The display system according to claim 8, the combination further including an elevator well located beneath the lower limit of travel of the elevator cab, said light generating means being mounted within said elevator well so that said light generating means is not visible from outside the elevator shaft.

10. The display system according to claim 8 wherein said light generating means comprises a bank of laser devices which generate light energy at selected frequencies and colors.

11. The display system according to claim 1, said visual display means comprising an electrical lamp, a magnetic member, a detector circuit having a sensor coil, and a gate controlled switch connected in electrical series relation with said lamp, said detection circuit conducting an output signal to the gate of said switch in response to the induction of current through said coil, said lamp and said detector circuit being disposed along the path of travel of said cab, and said magnetic member being disposed for magnetic coupling with said sensor coil as said cab traverses said coil.

12. A display system, comprising:

a vertically extending elevator shaft open along one side thereof;

an elevator cab mounted in said shaft and being moveable therein between predetermined upper and lower limits in said shaft;

drive means for selectively raising and lowering the elevator cab in the shaft;

an elevator well located beneath the lower limit of travel of the cab; and, banner means having a visual display imprinted thereon, said banner means being at least partially disposed within the elevator well and being attached at one end thereof to the elevator cab for being payed out from the elevator well as the cab rises in the shaft and for being retracted into the well as the cab descends in the shaft, thereby providing a visual display between the elevator cab and elevator well which is changeable in accordance with the movement of the cab.

13. A display system, comprising:

a vertically extending elevator shaft;

an elevator cab mounted in the shaft and being moveable between predetermined upper and lower limits in the shaft;

drive means for selectively raising and lowering the elevator cab in the shaft;

an elevator well located beneath the lower limit of travel of the elevator cab;

light generating means disposed in said elevator well for emitting light energy upwardly into the elevator shaft; and a reflective member mounted on a surface of the elevator cab which is in facing relationship with the light generating means for reflecting light energy, the transmission and reflection of light energy between the light generating means and the reflective member providing a visual display between the elevator cab and the elevator well, said display being changeable in accordance with the position and movement of the elevator cab.

14. The display system according to claim 13 wherein said light generating means is comprised of a plurality of laser devices which emit light energy at selected frequencies and colors.

* * * * *